US008105183B2

(12) United States Patent
Yoo et al.

(10) Patent No.: US 8,105,183 B2
(45) Date of Patent: Jan. 31, 2012

(54) CELLULOID-FREE TABLE-TENNIS BALL

(75) Inventors: In Sook Yoo, Würzburg (DE); Thomas Wollheim, Bayreuth (DE)

(73) Assignee: In Sook Yoo International Project Management—IPM, Würzburg (DE)

( * ) Notice: Subject to any disclaimer, the term of this patent is extended or adjusted under 35 U.S.C. 154(b) by 457 days.

(21) Appl. No.: 11/991,584

(22) PCT Filed: Sep. 14, 2006

(86) PCT No.: PCT/EP2006/008963

§ 371 (c)(1),
(2), (4) Date: Aug. 31, 2009

(87) PCT Pub. No.: WO2007/031315

PCT Pub. Date: Mar. 22, 2007

(65) Prior Publication Data

US 2010/0009791 A1 Jan. 14, 2010

(30) Foreign Application Priority Data

Sep. 15, 2005 (DE) ..... 10 2005 044 178

(51) Int. Cl.
*A63B 37/02* (2006.01)

(52) U.S. Cl. ..... 473/355; 428/35.7; 473/351; 473/358; 473/604; 156/73.1

(58) Field of Classification Search ..... 428/35.7, 428/35.5; 473/351, 355, 358, 604; 156/245, 156/73.1, 91
See application file for complete search history.

(56) References Cited

U.S. PATENT DOCUMENTS

| | | | | |
|---|---|---|---|---|
| 2,633,894 | A * | 4/1953 | Carwile | 156/73.5 |
| 4,105,722 | A * | 8/1978 | Sorenson | 261/94 |
| 2010/0009791 | A1 * | 1/2010 | Yoo et al. | 473/604 |
| 2010/0210745 | A1 * | 8/2010 | McDaniel et al. | 521/55 |

FOREIGN PATENT DOCUMENTS

| | | |
|---|---|---|
| DE | 1 479 127 | 2/1969 |
| DE | 1 478 024 | 8/1970 |
| GB | 1 222 901 | 2/1971 |

* cited by examiner

*Primary Examiner* — N. Edwards
(74) *Attorney, Agent, or Firm* — Pandiscio & Pandiscio

(57) ABSTRACT

The invention relates on one hand to a celluloid-free table-tennis ball, preferably having a diameter of 38.5 to 48 mm, a weight between 2.0 and 4.5 grams, and a shell thickness (approximately) between 0.20 mm and 1.30 mm, where the shell is composed of plastic, whose principal component is an organic non-crosslinked polymer, which in its main chain has not only carbon atoms but also heteroatoms; and on the other hand also to a process of manufacturing a table-tennis ball of this kind, where mostly in a first step two or more shell parts are manufactured, these shell parts are joined in a subsequent step.

34 Claims, No Drawings

CELLULOID-FREE TABLE-TENNIS BALL

The invention relates on one hand to a celluloid-free table-tennis ball, preferably having a diameter of 38.5 to 48 mm, a weight between 2.0 and 4.5 grams, and a shell thickness (approximately) between 0.20 mm and 1.30 mm, where the shell is composed of plastics, whose principal component is an organic, non-crosslinked polymer, and on the other hand a manufacturing process of such a table-tennis ball.

Since about 1930, celluloid is worldwide used as material for table-tennis balls. Celluloid features, however, some essential disadvantages. These disadvantages are extensive manufacture using many solvents, difficult manufacturing of secondary products, explosion hazard. Due to these facts, celluloid is manufactured and processed today almost exclusively in East Asian countries. Quite often accidents happen thereby. Relating to the table-tennis ball, this causes to the fact that the world market completely depends on the manufacturing in China, Japan, and Korea. Increasingly, the technical material properties of celluloid become a problem, because die manufacturing tolerances leave the range accepted by the players.

There is a set of rules for the table-tennis ball defined by the International Table Tennis Federation (ITTF). These are specified by ITTF Technical Leaflet T3. At present following characteristics are defined:

1. Diameter: 39.5 mm to 40.5 mm
2. Weight: 2.67 g to 2.77 g
3. Veer: On a rolling course of 1 m in length, the ball having a roll speed of about 0.3 m/sec., should not differ more than 175 mm
4. Hardness at pole: a piston with 20 mm diameter, a compressive force of 50 N, and a speed of 10 mm/min is allowed to impress the ball at pole between 0.71 and 0.84 m
5. Hardness at equator: such as pole meter; values between 0.72 and 0.84 mm
6. Variance of hardness by pole and equator measurement: less than 0.15 mm
7. Standard deviation of hardness: less than 0.06 mm
8. Bounce: jump height between 240 mm and 260 mm at a drop height of 305 mm to a standard steel block.

Diameter and weight are thereby by the international regulations largely defined characteristics, the veer is such a defined and desired quality, while the according 4 to 8 defined, mechanical properties describe the properties of the used celluloid ball.

General mechanical properties, which characterize a marketable ball, are:

- Complete and not visible recovery of deformations within a few milliseconds
- No stress-whitening and other, irreversible material changes under load
- Stability at impact on a rubber coated surface with a relative speed of up to 250 km/h
- Stability at impact on a stiff, coated surface with a relative speed of up to 120 km/h
- breaking strength of material and possible seam by 5000-fold repeated impact at described contact settings
- Stability at rotations up to 180 revolutions per second As well decisive for the acceptance of the table-tennis ball is the opinion of the players, which judge the ball by play feeling, subjective hardness, and bounce. By the use of celluloid for decades a very established standard has been developed, whereby the new materials must be measured. A decisive property is thereby the sound of the table-tennis ball at bounce on a stiff surface, e.g., on a desk.

In the Eighties, the Dunlop Company, UK, tried to replace the material celluloid, as well as in 1990 the Double Fish company, China. All of these attempts failed until now. The reason for the failure is the fact that the specific properties of celluloid cannot achieve by the new materials.

In GB 1 222 901 of the Dunlop Company the use of styrene-acrylnitrile-acrylic elastomers as shell material is described. The ball was experimentally applied to play in the Eighties, but due to irreversible material deformations (buckles) withdrawn. Moreover, the ball did not have the same play characteristics as celluloid.

In the DE 103 15 154 A1 the integration of macroscopic structural elements in the shell of plastic table-tennis balls is described. This patent describes not the basic plastic of the ball, but only possibilities for its modification.

According to this, it is not succeeded so far, to find a material, which approximately describes the play characteristics of celluloid. Bounce, sound at bounce, hardness at various points of the surface, friction on the surface, the feeling during the contact bat-ball, and rotational behavior are part of these play characteristics of the ball.

From these disadvantages of the previous state of the art results the problem initiated the invention, to find a basic material of a table-tennis ball that is not celluloid and allows of the manufacture of balls with play characteristics similarly to those of celluloid by similar mechanical properties. In addition, a large-scale production of the table-tennis balls using this material by today commonly industrial processes should be possible.

The solution of this problem succeeds that the organic polymer exhibits in the main chain not only carbon atoms but also heteroatoms.

It has been shown that by the use of such plastic materials it is possible to replace the disadvantageous material celluloid in the table tennis ball production and to maintain the playing characteristics in the process largely. In addition, thereby the production can be arranged ecological and economic.

It has proved to be favorable that the organic polymer has no nitrogen atoms outside the main chain. Such a nitration changes the material properties rather negatively.

By the invention, it is possible to use a thermoplastic with a homogeneous structure without fillers and/or reinforcement materials, which can be better processed than inhomogeneous material.

It has been shown, that the principal component of the substance according to the invention should have a minimize water absorption, particularly a water absorption at standard climate according to DIN EN ISO 62 of less than 1.0%. Thereby uncontrolled swelling is excluded.

Otherwise the ball indentation hardness according DIN EN ISO 2039-1 of the substance according to the invention should be at 120 MPa or higher, so that table tennis ball can be made corresponding to common demands.

Furthermore, the invention recommends to use such substances, that principal component has a density according to DIN EN ISO 1183 of 1.22 g/cm$^3$ or more. With these by predetermined cross-section of the shell, the weight of a table-tennis ball can be optimal adjusted.

The principal component of substance according to the invention should feature a long-term service temperature of 80° C. or more (engineering thermoplastics, high temperature thermoplastics) in order to be sufficiently resistant to thermal exposure. Substances, whose main component exhibits long-term service temperature of 150° C. or more (high temperature thermoplastics), are still better suited.

If the principal component is semi-crystalline, by partially parallel adjustment of polymer chains a high stability can be set, which is just important to comparatively thin shell.

Within the invention, the principal component of the shell is one of the following substances: Polyoxymethylene (POM), polybutylene terephthalate (PBT), polyethylene terephthalate (PET), polysulphone (PSU), polyether imide (PEI), polyetherether ketone (PEEK), polyethylene naphthalate (PEN), polybutylene naphthalate (PBN), polytrimethylene terephthalate (PTT), or a copolymer of one or several of these substances.

These plastics are characterized by a good processability with different shaping techniques such as thermoforming or injection molding and could be further modified and adapted by specific modification of the basic components or by appropriate blends. In extensive test series, these different plastic materials were pre-selected based on their mechanical characteristics and afterwards tested by manufacturing and testing table-tennis balls with the appropriate standard size und standard weight. Particularly good results were achieved by partly aromatic polyesters and POM.

If the molding material is a mixture or a blend of one or several of mentioned plastics, substances with particularly favorable properties can be created.

If necessary, selected, mainly mechanical properties of the table-tennis ball can be improved by modifying the molding material by nanofillers, preferably layered silicates, nanotubes, or spherical nanoparticles.

A possibly further development serves to the same in such a way, that the shell has a structured inner surface, and/or a structured outer surface.

Further it is possible, that the shell has a tailored variation of the wall thickness to compensate inhomogeneities or anisotropies by the manufacturing process (e.g. welding of two half shells) where required.

This makes it possible, to join the table-tennis ball from a multipart, preferably two-piece, shell, what is proved particularly economical.

Optimal characteristics has the table-tennis ball, if it achieves by impact of 305 mm height on a standard stone plate a jump height between 220 mm und 280 mm, and shows on its surface at a compressive force of 50 N on an area of 20 mm diameter on the ball's surface a reversible deformation between 0.65 mm und 0.90 mm with a standard deviation of about various points of the surface of less than 0.20 mm.

A method of manufacturing of a table-tennis ball according to the invention is characterized, that in a first step several shell parts are manufactured, which are joined in a following step.

It has been shown that for these purpose the newly found materials are particularly suitable to join, by application of modern technologies the forming of a welding seam could be largely or completely avoided. Where necessary the surface can be smoothed to remove seam residues completely.

The shells respectively shell parts are manufactured by forming a blank, e.g., a flat body, e.g., by thermoforming. This procedure can be implemented possibly near or below the softening temperature, so that the material behavior is very well controllable.

Furthermore, it is also possible to manufacture shells respectively shell parts by shaping from a liquid or paste-like molding compound by a molding process, e.g. by injection molding. Thus, the cross-section can be accurately affected and thereby a constant shell thickness guaranteed.

The invention recommends that the shell parts be joined by gluing, welding, and/or clips. While the first procedures result in a very stable table-tennis ball, by the last procedure an accurately defined cross-section of the ball can be guaranteed also at join patch. By a strong enough undercut, it is achieved that the two shell parts cannot be separated without destruction of the ball.

The expenditure in manufacturing can be further reduced by joining the shell parts directly in the tool, preferably by assembly injection molding or hollow body injection molding.

By the use of modern, plastics processing techniques it is possible to vary specifically the wall thickness of the shell, especially between equator and pole, preferably during the injection molding process to compensate the anisotropy caused by joining.

Finally, it corresponds to lore of invention that during the manufacture of the ball one or more steps run at a minimum temperature of 110° C., preferably at more than 140° C. Here the thermoplastic material is particularly well ductile.

EXAMPLES

Further characteristics, properties, and advantages based on the invention result from following description of some preferred embodiments of the invention.

Example 1

A table-tennis ball was made from two injection molded PEI half shells, which were joined after a plasma surface treatment by a polyvinyl butyral hot-melt adhesive.

Example 2

A table-tennis ball was made from two injection molded PET half shells, which were joined after plasma surface treatment by reaction adhesive on epoxy basis.

Example 3

A table-tennis ball was made from two thermoformed POM half shells, which were joined after surface treatment by reaction adhesive on epoxy basis.

The invention claimed is:

1. A celluloid-free table-tennis ball, the ball having a diameter of 38.5 to 48 mm, a weight of 2.0 to 4.5 grams, and a shell having a wall thickness of 0.20 mm to 1.30 mm, wherein the shell is composed of plastics whose principal component is an organic non-crosslinked polymer, which in its main chain has carbon atoms and heteroatoms, and wherein the principal component is a) a thermoplastic material, b) having a density according to ISO 1183 of more than 1.22 g/cm$^3$, and c) water absorption according to ISO 62 of less than 1.0%.

2. A celluloid-free table-tennis ball, the ball having a diameter of 38.5 to 48 mm, a weight of 2.0 to 4.5 grams and a shell thickness of 0.20 mm to 1.30 mm, wherein the shell is composed of plastics whose principal component is an organic non-crosslinked polymer, which in its main chain has carbon atoms and heteroatoms, and wherein the principal component is a) a thermoplastic material; that is semi-crystalline and/or has a long-term service temperature of at least 150° C., and b) has a density according to ISO 1183 of more than 1.22 g/cm$^3$, and c) water absorption according to ISO 62 of less than 1.0%.

3. The table-tennis ball according to claim 1, wherein the organic polymer component has no group of nitrate.

4. The table-tennis ball according to claim 1, wherein the organic polymer component has no nitrogen atoms outside the main chain.

5. The table-tennis ball according to claim 1, wherein the thermoplastic material has a homogeneous structure without fillers and reinforcement materials.

6. The table-tennis ball according to claim 1, wherein the principal component has ball indentation hardness according to ISO 2039-1 of at least 120 MPa.

7. The table-tennis ball according to claim 1, wherein the principal component of the shell is a substance selected from a group of substances consisting of: Polyoxymethylene (POM), polybutylene terephthalate (PBT), polyethylene terephthalate (PET), polysulphone (PSU), polyether imide (PEI), polyetherether ketone (PEEK), polyethylene naphthalate (PEN), polybutylene naphthalate (PBN), polytrimethylene terephthalate (PTT), and a copolymer of one of the substances.

8. The table-tennis ball according to claim 7, wherein the principal component is a mixture or a blend of at least two of the substances.

9. The table-tennis ball according to claim 1, wherein the thermoplastic material is modified by nanofillers.

10. The table-tennis ball according to claim 1, wherein the shell is provided with a structured inner surface.

11. The table-tennis ball according to claim 1, wherein the shell is provided with a structured outer surface.

12. The table-tennis ball according to claim 1, wherein the shell has a variation of wall thickness.

13. The table-tennis ball according to claim 1, wherein the ball shell comprises a one-piece shell.

14. The table-tennis ball according to claim 1, wherein the ball shell is two-piece shell.

15. The table-tennis ball according to claim 1, wherein the ball is adapted to achieve by impact of 305 mm height on a standard stone plate a jump height of from 220 mm to 280 mm, and shows on its surface at a pressure of 50 N on an area of 20 mm diameter a reversible deformation of from 0.65 mm to 0.90 mm with a standard deviation of less than 0.20 mm.

16. A process for manufacturing of a table-tennis ball according to claim 1, wherein a plurality of shell parts are manufactured and joined in a subsequent step.

17. The process according to claim 16, wherein the shell parts are manufactured by deformation of a blank.

18. The process according to claim 16, wherein the shell is manufactured by molding from a molding compound.

19. The process according to claim 16, wherein the shell parts are joined by a selected one of gluing, welding, and clips.

20. The process according to claim 16, wherein the shell parts are joined by a selected one of rotational welding, ultrasonic welding, induction welding, and laser welding.

21. The process according to claim 16, wherein the shell parts are directly joined in a mold.

22. The process according to claim 12, wherein shaping measures are used to provide the tailored variation of wall thickness of the shell.

23. The process according to claim 16, wherein during manufacture of the ball at least one step is conducted at a temperature of 110° C. to more than 140° C.

24. The table-tennis ball according to claim 2, wherein the organic polymer has no group of nitrate.

25. The table-tennis ball according to claim 2, wherein the organic polymer component has no nitrogen atoms outside the main chain.

26. The table-tennis ball according to claim 2, wherein the thermoplastic material has a homogeneous structure without fillers or reinforcement material.

27. The table-tennis ball according to claim 2, wherein the principal component has ball indentation hardness according to ISO 2039-1 of at least 120 Mpa.

28. The table-tennis ball according to claim 2, wherein the principal component of the shell is a substance selected from a group of substances consisting of: Polyoxymethylene (POM), polybutylene terephthalate (PBT), polyethylene terephthalate (PET), polysulphone (PSU), polyether imide (PEI), polyetherether ketone (PEEK), polyethylene naphthalate (PEN), polybutylene naphthalate (PBN), polytrimethylene terephthalate (PTT), and a copolymer of one of the substances.

29. The table-tennis ball according to claim 28, wherein the principal component is a mixture or a blend of at least two of the substances.

30. The table-tennis ball according to claim 2, wherein the thermoplastic material is modified by nanofillers.

31. The table-tennis ball according to claim 2, wherein the ball shell comprises a one-piece shell.

32. The table-tennis ball according to claim 2, wherein the ball shell is a two-piece shell.

33. The table-tennis ball according to claim 2, wherein the ball is adapted to achieve by impact of 305 mm height on a standard stone plate a jump height of from 220 mm to 280 mm, and shows on its surface at a pressure of 50 N on an area of 20 mm diameter a reversible deformation of from 0.65 mm to 0.90 mm with a standard deviation of less than 0.20 mm.

34. The process according to claim 32, wherein the shell pieces are joined by a selected one of rotational welding, ultrasonic welding, induction welding, and laser welding.

* * * * *